US005562530A

United States Patent [19]

Runnels et al.

[11] Patent Number: 5,562,530

[45] Date of Patent: Oct. 8, 1996

[54] PULSED-FORCE CHEMICAL MECHANICAL POLISHING

[75] Inventors: Scott Runnels, Austin; L. Michael Eyman, San Antonio, both of Tex.

[73] Assignee: Sematech, Inc., Austin, Tex.

[21] Appl. No.: 284,315

[22] Filed: Aug. 2, 1994

[51] Int. Cl.[6] ..... B24B 1/00

[52] U.S. Cl. ..... 451/36; 451/41; 451/272

[58] Field of Search ..... 451/41, 42, 26, 451/63, 272; 156/625.1, 636.1; 437/225

[56] References Cited

U.S. PATENT DOCUMENTS

| | | | |
|---|---|---|---|
| 2,922,264 | 1/1960 | Mushrush . | |
| 3,436,286 | 4/1969 | Lange | 156/17 |
| 3,629,023 | 12/1971 | Strehlow | 156/17 |
| 3,748,790 | 7/1973 | Pizzarello et al. | 451/165 |
| 3,979,239 | 9/1976 | Walsh | 156/4 |
| 4,141,180 | 2/1979 | Gill, Jr. et al. . | |
| 4,193,226 | 3/1980 | Gill, Jr. et al. . | |
| 4,240,231 | 12/1980 | Day . | |
| 4,244,775 | 1/1981 | D'Asaro | 156/636 |
| 4,256,535 | 3/1981 | Banks | 156/645 |
| 4,270,314 | 6/1981 | Cesna . | |
| 4,319,432 | 3/1982 | Day . | |
| 4,373,991 | 2/1983 | Banks | 156/645 |
| 4,435,247 | 3/1984 | Basi et al. | 156/636 |
| 4,448,634 | 5/1984 | Lampert | 156/636 |
| 4,519,168 | 5/1985 | Cesna . | |
| 4,600,469 | 7/1986 | Fusco et al. | 156/636 |
| 4,645,561 | 2/1987 | Rea | 156/636 |
| 4,720,938 | 1/1988 | Gosis . | |

(List continued on next page.)

FOREIGN PATENT DOCUMENTS

| | | | |
|---|---|---|---|
| 63-62657 | 3/1988 | Japan | 451/165 |
| 63-62658 | 3/1988 | Japan | 451/165 |
| 63-62659 | 3/1988 | Japan | 451/165 |
| 63-62660 | 3/1988 | Japan | 451/165 |
| 1437934 | 6/1976 | United Kingdom . | |
| 1443299 | 7/1976 | United Kingdom . | |

OTHER PUBLICATIONS

"Controlled Wafer Backside Polishing"; J. S. Basi and E. Mendel; IBM Technical Disclosure Bull. vol.21, No.7; Dec. 78; p.2733.

"Wafer Thinning and Chemical Polishing Machine"; J. R. Hause and R. C. Kverek; IBM Technical Disclosure Bull., vol.23, No.9; Feb. 1981; pp. 4141–4142.

"Feature–Scale Fluid–Based Erosion Modeling for Chemical–Mechanical Polishing"; S. R. Runnels; J. Electrochem. Soc., vol.141, No.7;Jul. 1994 pp. 1900–1904.

"Tribology Analysis of Chemical–Mechanical Polishing"; S. R. Runnels et al. J. Electrochem. Soc., vol. 141, No. 6; Jun. 1994; pp. 1698–1701.

"Characterization of Mechanical Planarization Process"; Renteln et al.; VMIC Conference; Jun. 12–13, 1990; pp. 57–63.

"A Bowl Feed and Double Sides Polishing for Silicon Wafer for VLSI"; Nakamura et al.; Bull. Japan Soc. of Prec. Engg., vol. 19, No. 2; Jun. 1985; pp. 120–125.

"Fundamental Mechanics of Fluids"; I. G. Currie; McGraw Hill Book Company; NY; 1974; mostly pp. 3–36 and pp. 224–227.

"Chemical Polishing of Cadmium Sulfide"; M. V. Sullivan et al.; J. Electrochem. Soc., vol. 114, No. 3; Mar. 1967; pp. 295–297.

"Chemomechanical Polishing of CdS"; V. Y. Pickhardt et al.; J. Electrochem. Soc.,vol.121, No.8; Aug. 1974; pp. 1064–1066.

*Primary Examiner*—Maurina T. Rachuba
*Attorney, Agent, or Firm*—William W. Kidd

[57] ABSTRACT

A pulsed-force CMP scheme allows for the down force holding a wafer onto a pad to cycle periodically between minimum and maximum values. When the force is near its minimum value, slurry flows into the space between the wafer and the pad. When the force is near its maximum value, slurry is squeezed out allowing for the abrasive action of the pad surface to erode wafer surface features.

10 Claims, 2 Drawing Sheets

U.S. PATENT DOCUMENTS

| | | | |
|---|---|---|---|
| 4,805,348 | 2/1989 | Arai et al. . | |
| 4,826,563 | 5/1989 | Hassett et al. | 156/636 |
| 4,841,680 | 6/1989 | Hoffstein et al. . | |
| 4,842,678 | 6/1989 | Noro et al. | 156/636 |
| 4,860,498 | 8/1989 | Gosis . | |
| 4,879,258 | 11/1989 | Fisher | 437/225 |
| 4,910,155 | 3/1990 | Cote et al. | 437/8 |
| 4,916,868 | 4/1990 | Wittstock . | |
| 4,927,432 | 5/1990 | Budinger et al. . | |
| 4,940,507 | 7/1990 | Harbarger | 156/636 |
| 4,954,141 | 9/1990 | Takiyama et al. . | |
| 4,959,113 | 9/1990 | Roberts | 156/636 |
| 4,974,370 | 12/1990 | Gosis . | |
| 5,032,203 | 7/1991 | Doy et al. | 156/345 |
| 5,040,336 | 8/1991 | Ahern | 451/41 |
| 5,094,037 | 3/1992 | Hakomori et al. . | |
| 5,096,854 | 3/1992 | Saito et al. | 437/225 |
| 5,097,630 | 3/1992 | Maeda et al. . | |
| 5,099,614 | 3/1992 | Arai et al. . | |
| 5,104,828 | 4/1992 | Morimoto et al. | 437/225 |
| 5,123,218 | 6/1992 | Karlsrud . | |
| 5,137,544 | 8/1992 | Medellin . | |
| 5,157,876 | 10/1992 | Medellin . | |
| 5,177,908 | 1/1993 | Tuttle . | |
| 5,196,353 | 3/1993 | Sandhu et al. | 437/8 |
| 5,205,082 | 4/1993 | Shendon et al. . | |
| 5,209,816 | 5/1993 | Yu et al. | 156/636 |
| 5,212,910 | 5/1993 | Breivogel et al. . | |
| 5,216,843 | 6/1993 | Breivogel et al. . | |
| 5,225,034 | 7/1993 | Yu et al. | 156/636 |
| 5,230,182 | 7/1993 | Daniell et al. | 451/165 |
| 5,232,875 | 8/1993 | Tuttle et al. | 437/225 |
| 5,234,867 | 8/1993 | Schultz et al. | 437/225 |
| 5,240,552 | 8/1993 | Yu et al. | 156/636 |
| 5,245,790 | 9/1993 | Jerbic . | |
| 5,245,796 | 9/1993 | Miller et al. . | |
| 5,246,525 | 9/1993 | Sato | 156/345 |
| 5,257,478 | 11/1993 | Hyde et al. . | |
| 5,267,418 | 12/1993 | Currie et al. . | |

PULSED-FORCE CHEMICAL MECHANICAL POLISHING

BACKGROUND OF THE INVENTION

1. Field of the Invention

The present invention relates to the field of semiconductor manufacturing techniques and, more particularly, to a technique for planarizing semiconductor wafers.

2. Prior Art

The art is abound with references pertaining to techniques for polishing a surface. Various semiconductor polishing techniques today can be traced back to the polishing methods employed to polish optical lenses. Similar techniques have been utilized in the semiconductor field to polish bare wafers, which are then used as the base substrate for manufacturing integrated circuit devices. Thus, a number of methods are known in the prior art for polishing bare wafers, such as a silicon wafer.

The manufacture of an integrated circuit device requires the formation of various layers (both conductive and non-conductive) above the base substrate to form the necessary components and interconnects. During the manufacturing process, removal of a certain layer or portions of a layer must be achieved in order to pattern and form the various components and interconnects. Generally this removal process is termed "etching" or "polishing."

One of the techniques available for etching is the chemical-mechanical polishing (CMP) process in which a chemical slurry is used along with a polishing pad. The mechanical movement of the pad relative to the wafer provides the abrasive force for removing the exposed surface of the wafer. Because of the broad surface area covered by the pad in most instances, CMP is utilized to planarize a given layer. Planarization is a method of treating a surface to remove discontinuities, such as by polishing (or etching), thereby "planarizing" the surface.

It has been theorized that abrasive material removal from a semiconductor wafer surface requires actual pad-wafer contact for proper CMP to occur. Another theory states that the actual material removal is achieved by the pad pressure on a hydrodynamic layer which is generally the slurry disposed between the wafer and the pad. However, what is known is that the presence of the slurry is required for obtaining optimum results in performing CMP.

A variety of techniques and tools for performing CMP are well-known in the prior art. U.S. Pat. Nos. 4,141,180 and 4,193,226 are just two examples of earlier schemes. After initial usage of CMP in semiconductor planarization, the practice lost ground to other forms of etching. The industry generally favored the usage of dry techniques, such as ion and plasma etching. However, with the advent of larger wafer sizes and smaller sub-micron dimensioned devices being formed on these wafers, CMP is again being viewed in favorable light as one of the preferred techniques available for planarization. U.S. Pat. Nos. 5,245,790 and 5,245,796 are just two examples of more recent interest in the CMP technology.

However, the application of existing CMP tools and methods to the new generation of sub-micron devices has amplified previously known problems or created new ones. Due to the smaller dimensions, including the usage of thinner semiconductor layers, tighter tolerances are now needed. Where certain tolerances were permitted with the older generation devices, these tolerances are no longer acceptable. Additionally it is preferred to obtain process uniformity while performing CMP from one wafer to the next.

A major difficulty with the prior art techniques is in maintaining a consistent combination of even slurry distribution between the wafer and pad along with uniform abrasion of the exposed wafer surface. Because of the difficulty in controlling the amount of slurry present between the wafer and the pad, it is difficult to maintain a steady and consistent control on the planarization process. Although a number of approaches have been devised, such as cutting grooves in the pad, process control is still lacking.

Therefore, it is appreciated that a novel technique for attempting to control and better predict the planarization process parameters is desirable. This is especially true as the technology for developing future generations of memory devices, such as 256 Megabyte and 1 Gigabyte DRAMs and beyond, are exploited. The present invention addresses this need.

SUMMARY OF THE INVENTION

A pulsed-force method and apparatus for performing chemical-mechanical polishing is described. In order to provide for substantially continuous hydrodynamic lubrication and pad-wafer abrasion, a force exerted for pad-wafer contact is pulse driven. This down-force is controlled by a periodic waveform transitioning (pulsing) between high and low values.

When the force exerted is at its lower values, the pad-wafer contact is decreased, allowing for slurry to flow between the wafer and the pad. Therefore, at the lower force values, the slurry flow provides a hydrodynamic lubrication. When the force exerted is at its higher values, the pad-wafer contact is increased, allowing for the slurry to be squeezed out between the wafer and the pad. This action allows for the abrasive action of the pad to remove material (polish) from the wafer.

Accordingly, by pulsing the down force between its low and high values, much improved controls can be placed on processing a wafer using CMP. The pulsed-force CMP technique of the present invention thus allows for alternating cycles of lubrication and abrasion to provide for a substantially continuous and controllable process to polish semiconductor wafers.

Economic Advantage

The practice of the present invention permits for improved controls in performing CMP. Such improvements allow for the manufacture of next generations of semiconductor devices and, further, has a potential for improving the product yield and reducing manufacturing costs.

DETAILED DESCRIPTION OF THE PREFERRED EMBODIMENTS

The present invention pertains to a method and apparatus for planarizing layers on a semiconductor wafer by the use of a pulsed-force chemical-mechanical planarization (CMP) technique. In the following description, numerous specific details are set forth, such as specific shapes, materials, structures, compositions, etc., in order to provide a thorough understanding of the present invention. However, it will be obvious to one skilled in the art that the present invention may be practiced without these specific details. In other instances, well known processes and structures have not been described in detail in order not to unnecessarily obscure the present invention.

The technique described herein is referred to as a "pulsed-force chemical-mechanical polishing (PFCMP)" technique. Although a novel apparatus can be designed to incorporate the method of the present invention, it is appreciated that a variety of prior art polishing equipment can be readily adapted to implement the technique of the present invention as well. Furthermore, once the technique described herein is disclosed, those ordinarily skilled in the art can readily implement the technique in a variety of ways. However, the description of the present invention is better understood when referenced to an operative theory pertaining to current CMP techniques.

Figure 1:
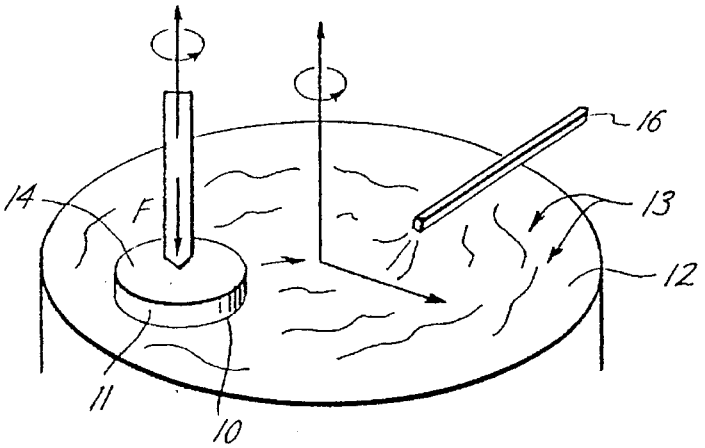
Fig. 1 PRIOR ART
FIG. 1 is a pictorial diagram of a typical prior art CMP tool.

Referring to FIG. 1, a typical set up of a tool for performing CMP is shown. A wafer 10 supported by a wafer carrier 14 is placed face-down on to a polishing pad 12 so that a surface 11, which is to be polished (etched), rests against the surface of the pad 12. The wafer carrier 14 is coupled to equipment (not shown) which provides for the rotation of the wafer 10 relative to the pad 12. In most instances, the pad 12 is also rotated so that both the wafer 10 and pad 12 rotate. A slurry 13 is made to flow over the pad surface so as to provide a hydrodynamic layer between the wafer surface 11 and pad 12 during the polishing operation. The slurry 13 is necessary to perform the CMP operation.

Additionally, in many CMP tools the carrier 14 is made to move horizontally over the whole of the pad, so that it is not disposed only over a portion of the pad area underlying the wafer at the start of the CMP process. Therefore, in most instances, the pad 12 has a larger surface area than the wafer 10 itself. The horizontal movement aids in the distribution of the slurry 13, as well as reducing pad wear. Finally, a slurry delivery system 16 is utilized to deliver and flow the slurry 13 onto the pad 12 surface.

It is to be appreciated that the general technique for performing CMP, as described above, is well-known in the prior art. Types of slurries, slurry delivery systems, pad designs and the complete tool for performing CMP are also well-known in the prior art. A variety of tools and equipment are available for purchase, in order to perform CMP on a semiconductor wafer, such as a silicon wafer. However, it is also well-known that significant problems are present in the current generation of CMP tools. One problem in particular is in maintaining steady slurry distribution between the wafer and the pad while maintaining consistently high abrasive material removal, during the complete polishing cycle.

It is unclear how much of the wafer is removed by direct pad-wafer contact, but it is certainly clear that the presence of the slurry is necessary to achieve desired polishing results for CMP. Therefore, the presence of the slurry is essential for performing CMP and that continuous replenishment of the slurry layer between the wafer and pad is absolutely necessary for optimum CMP performance.

It is also to be noted that a number of techniques have been devised to maintain a continuous slurry distribution between the pad and the wafer. Treatment of the pad surface is one approach. One technique employs the cutting of grooves in the pad to direct the slurry flow to the exposed wafer surface. Another technique which is receiving more usage is noted below in the discussion pertaining to FIG. 2.

Figure 2:
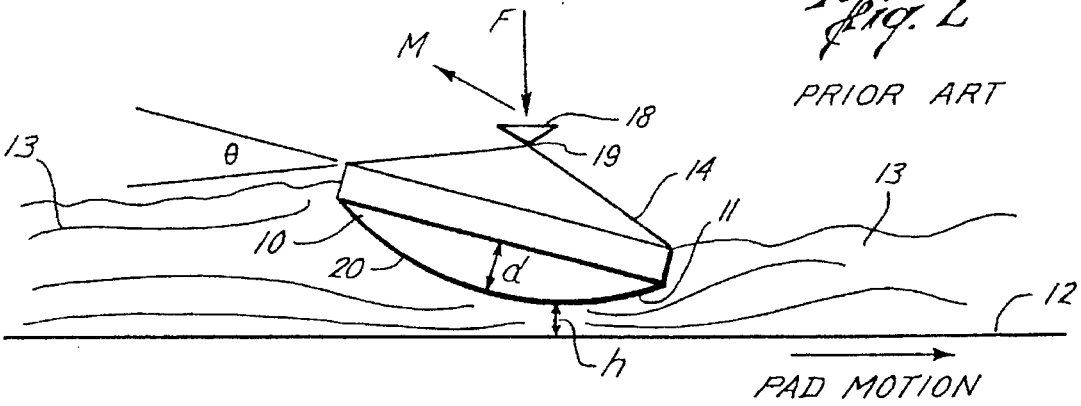
Fig. 2 PRIOR ART
FIG. 2 is a pictorial diagram of a typical prior art CMP tool using a gimbal to pivot a wafer.

Referring to FIG. 2, the same wafer 10, carrier 14 and pad 12 structures as FIG. 1 are shown but now with the inclusion of a gimbal 18. Gimbal 18 is located at the wafer carrier 14 so that the carrier 12, along with wafer 10, will freely pivot about the gimbal point 19. It has been shown through experimentation that the pivoting of the wafer further aids in improving the polishing of the wafer. It is theorized that as the wafer 10 transitions across the pad 12, the wafer 10 swings about the gimbal point 19, thereby permitting the slurry 13 to establish a hydrodynamic layer between the wafer surface 11 and pad 12. However, even with this improvement to the prior art CMP tool, it is still difficult to control the polishing of the wafer, let alone obtain consistent polish repeatability from wafer to wafer.

Although not shown in FIG. 1, but exaggerated in the illustration of FIG. 2, the surface 11 of wafer 10 can actually be slightly curved. This curvature is exaggerated in the drawing of FIG. 2, but what is to be noted is that the amount of the deformation of the wafer is directly related to the dome height "d" at the center of the wafer. Dome height d is the extent of the convex deformity at the center of the wafer. The space (distance) between the wafer surface 11 and pad 12 is denoted as "h" and will vary across the wafer surface. The amount of the variation is directly related to the dome height d. During actual operation, h will change as wafer and pad motion will necessarily cause h to fluctuate.

It is to be appreciated that in the above descriptions, the actual downward (normal) force F exerted on the wafer is substantially constant. Other than this vertical downward force F, a tangential force is exerted on the surface of the wafer, which force is noted as "pad motion" in FIG. 2. An inclination of the wafer 10 relative to the pad 12 is noted as attack angle $\Theta$. When $\Theta$ is equal to zero, the pad would be tangent to the surface 11 at the center of the wafer. Thus, when $\Theta$ equals zero, the shortest h ($h_{min}$) is encountered at the center and the longest h ($h_{max}$) at the edges of the wafer.

However, if the angle is changed, the tangent point will move away from the center, causing $h_{min}$ to shift toward the edge of the wafer as the value of $\Theta$ increases. Therefore, another factor affecting the location and the value of h is the value of angle $\Theta$, which is determined by the angle of pad 12 relative to wafer 10.

Other factors affecting the value of h are the relative value of a downward force F and the composition and flow of slurry 13. The downward force F exerts at least a portion of the necessary force for performing CMP. It is to be noted that force F is maintained relatively constant when using existing CMP techniques. In reference to viscosity, studies have shown that distance h is affected by viscosity, which in turn is affected by temperature changes as well. It should be noted that the presence of the slurry is critical for the proper operation of polishing the surface 11. However, because of the variability of the hydrodynamic slurry layer, it is difficult to maintain a constant polishing characteristic during the utilization of existing CMP techniques.

The analysis of the components of FIGS. 1 and 2 show that for existing processes, the pad-wafer interface is an unstable mix of hydrodynamic lubrication by the slurry and direct pad-wafer contact. It has been theorized that abrasive material removal from the wafer surface 11 requires actual pad-wafer contact. Another theory is that the actual material removal is achieved by the pad pressure on the hydrodynamic layer. Whichever theory is applied, the fact of the matter is that the slurry must be present for achieving optimum results in performing CMP.

The analysis is a straightforward application of computational fluid dynamics. The slurry 13 is treated as a thin film of fluid between the surface 11 and pad 12. The slurry is characterized by its thickness h and attack angle Θ. The flow of the slurry is computed and the stresses on the surface 11, which result from the flow, are integrated to determine the net upward force on the wafer 10 along with their moment M (shown emanating out of the page) about the gimbal point 19. The computations are repeated for various h/Θ pairs until one is found such that the net upward force on the wafer matches F and the moment about the gimbal point is zero.

This relationship can be better described using the incompressible form of the Navier-Stokes equations for Newtonian fluid as noted below.

$$(\rho U_i)\,(\partial U_j \partial X_i) = -(\partial P/\partial X_j) + \mu(\partial^2 U_j/\partial X_i \partial X_i) \qquad \text{(Eq. 1)}$$

$$\partial U_i/\partial X_i = 0 \qquad \text{(Eq. 2)}$$

where ρ is the slurry density, μ is the slurry viscosity, P is the pressure and U is the vector-valued velocity at any point in the flow. Further analysis of this relationship is described in a copending application entitled "Forced-Flow Wafer Polisher"; Ser. No. 08/284,316; filed Aug. 2, 1994, which application is incorporated by reference herein. In this particular instance, a stress free boundary condition is presumed at the outer edge of the fluid film.

In one example, results have shown that for the following polish conditions: (1) platen and carrier rotation speeds of 20 rpm; (2) slurry density of 997 kg/m$^3$; and (3) slurry viscosity μ of 0.8908+10$^{-3}$ kg/ms, a hydrodynamic layer with h=65 microns exists between the pad and the wafer.

Figure 3:
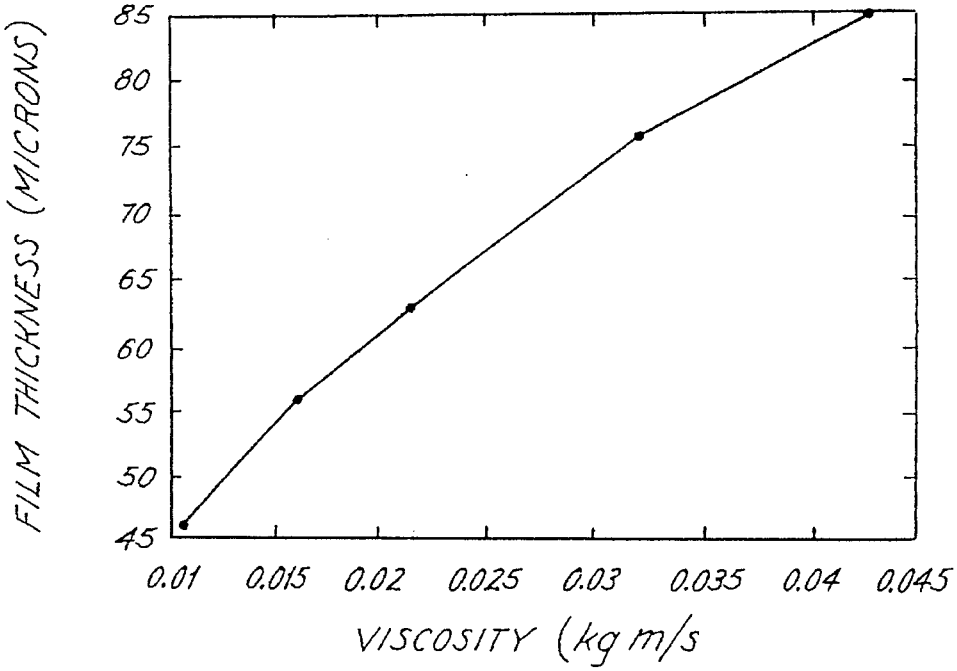
FIG. 3 is a graphical diagram showing changes in slurry film thickness as viscosity of the slurry changes.
Figure 4:
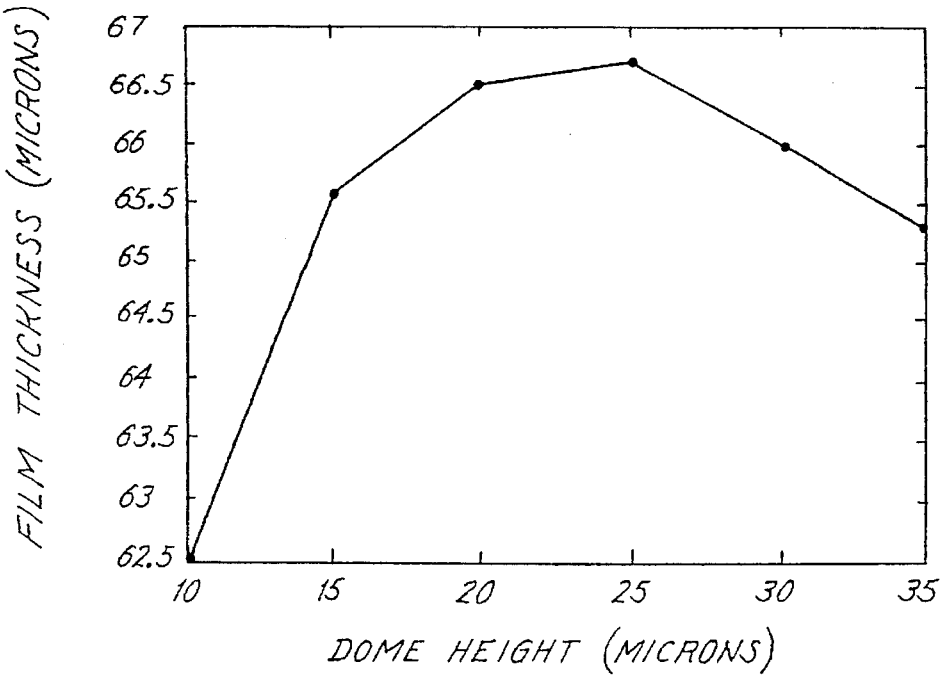
FIG. 4 is a graphical diagram showing changes in slurry film thickness as dome height of a wafer changes.

Applying this analysis, it is readily evident to determine the sensitivity of the hydrodynamic layer based on viscosity and wafer curvature. Additionally, FIG. 3 illustrates that slight variations in viscosity, which could be due to temperature changes alone, can result in dramatic changes for h due to the change in the thickness of the slurry. Furthermore, FIG. 4 illustrates that variations in curvature (especially below 10 micron dome heights) can also result in dramatic changes in h as well due to changes in the curvature of the wafer.

Thus, with the use of the prior art CMP tools where downward force F is substantially constant, it is difficult to ascertain the value of h. The variations in h will result in varying polishing results and repeatability is difficult to achieve from wafer to wafer. An object of the present invention is to alleviate this problem.

Figure 5:
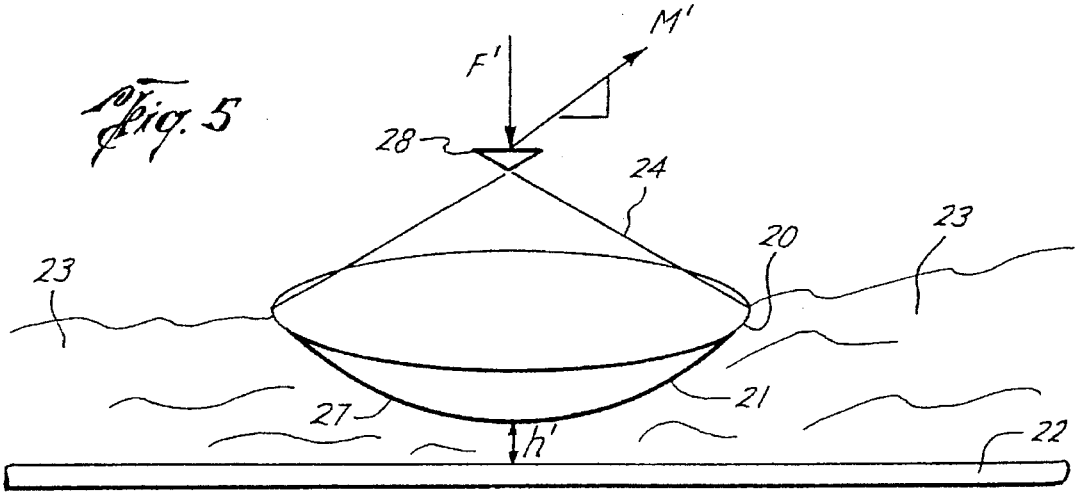
FIG. 5 is a graphical diagram showing the technique of the present invention in which a pulsed down force is used on a wafer.

Referring to FIG. 5, an illustration of the application of the present invention is shown in reference to a wafer undergoing a CMP process. It is to be appreciated that even though only two prior art schemes are shown in FIGS. 1 and 2, the present invention can be adapted to practice with a variety of prior art tools and/or techniques. Although the description below discusses the present invention without reference to a use of a gimbal, the present invention can be readily practiced with both gimbal and non-gimbal systems.

In FIG. 5, the wafer 20 is shown disposed adjacent to the polishing pad 22. Generally, surface 21 of wafer 20 would be parallel to pad 22, if surface 21 was flat. However, due to the curvature 27 of wafer 20, the distance (height "h'") between surface 21 and pad 22 at any particular point on the surface 21 will depend on that particular point relative to the center of the wafer. Typically, the minimum h' is encountered at the center of the wafer. However, if the wafer 20 is angled relative to the pad 22 as it traverses along the pad 22 (such will be the case when a gimbal 28 is used), the minimum h' may be encountered at some point other than at the center of the wafer. As shown in FIG. 5, a slurry 23 fills the space between the pad 22 and surface 21. This set up for CMP is equivalent to that illustrated in FIGS. 1 and 2. It is appreciated that the gimbal can be present (although not necessary) in the practice of the present invention.

However, in the practice of the present invention, a downward force F' pushing the wafer 20 onto pad 22 is made to vary at a predetermined rate. A preferred technique is to pulse F', utilizing a pulse pattern, such as a sinusoidal waveform or a triangular waveform, at a fairly low frequency. Frequencies in the approximate range of 0.5–4 Hz are applicable, but higher frequencies can be used. The actual frequency selected, as well as the pulse pattern, are design choices. However, the time period of the F' oscillations must be sufficiently slow in order to allow the slurry to flow between the wafer and the pad. A good estimate is to have the time required for slurry to be transported under the wafer to be approximately equal to D/V, where D is the diameter of the wafer being polished and V is the average pad speed. However, it is to be stressed that the actual values will depend on the particular tool, material and process being utilized.

The force F' exerted will vary between high and low limit values. Typical values for F' expressed in terms of pressure, are approximately 2–3 p.s.i. at the lower limit and approximately 9–12 p.s.i. at the upper limit. It is preferred that F' be periodic with a time-averaged value approximately equal to a desired fixed force F, if the process was originally designed having a constant force F. However, non-periodic pulsing, as well as variations on the value of F' can be used without departing from the spirit and scope of the present invention.

Due to the pulsed nature of the force being exerted, the process of the present invention has been referred to as "Pulsed-Force Chemical Mechanical Polishing" (PFCMP). During the lower values of F', the downward force is lessened thereby allowing a hydrodynamic layer of slurry to flow and accumulate in the region between the wafer 20 and the pad 22. During the higher values of F', the downward force is increased thereby squeezing out (reducing) the hydrodynamic layer and allowing for mechanical action from the pad surface to abrasively remove material from the wafer. Accordingly, a more uniform slurry layer is distributed during the polishing process under controlled conditions and abrasive removal of the wafer material can be controlled as well.

In the construction of the PFCMP tool, a variety of prior art devices can be readily implemented to provide the pulsing action. For example, the periodic waveform can be generated by electrical oscillations (generated from an oscillator or a signal generator). An electrical mechanical arm coupled to the wafer carrier then can be driven by the electrical oscillations. These techniques are well-known in the prior art.

Therefore, by the application of the present invention, a much more controlled CMP technique can be achieved to planarize layers on a surface, such as a semiconductor wafer, especially a silicon wafer. However, the present invention can be readily adapted to other areas of technology, such as in the manufacture of flat panel video displays. Thus a pulsed-force chemical-mechanical polishing technique is described.

We claim:

1. A method of polishing a surface by exerting a pulsed force directed substantially normal to said surface in combination with an abrasive motion directed across said surface to erode material from said surface, comprising the steps of:

placing said surface adjacent to an abrasive pad;

flowing a hydrodynamic layer of chemical slurry between said surface and said abrasive pad;

moving said surface relative to said abrasive pad in order to provide a mechanical motion between said surface and said abrasive pad for exertion of said abrasive motion across said surface;

providing a force directed substantially normal to said surface in order to press said surface against said abrasive pad;

pulsing said force at a set rate in order to vary said force being exerted on said surface by said abrasive pad;

wherein during periods of maximal force, said slurry is squeezed out from between said surface and said pad in order for said pad to abrasively remove said material; and during periods of minimal force, said slurry is replenished between said surface and said pad, but in order to permit said slurry to flow between said surface and said pad during periods of minimal force, said set rate must be of sufficiently low frequency so that ample time is available for slurry flow onto said surface before slurry is squeezed out from between said surface and said pad again during subsequent period of maximal force.

2. The method of claim 1 wherein said force has a time-averaged value approximately equal to a constant force value which would be utilized, if said polishing is achieved without pulsing said force.

3. The method of claim 2 wherein said force is pulsed at a frequency of approximately 0.5–4 Hz.

4. A method of polishing a surface of a semiconductor wafer by exerting a pulsed force directed substantially normal to said surface in combination with an abrasive motion directed across said surface to perform chemical-mechanical polishing for removing material from said surface, comprising the steps of:

placing said surface adjacent to an abrasive pad;

flowing a hydrodynamic layer of chemical slurry between said surface and said abrasive pad;

moving said surface relative to said abrasive pad in order to provide a mechanical motion between said wafer surface and said abrasive pad for exertion of said abrasive motion across said surface;

providing a force directed substantially normal to said surface in order to press said surface against said abrasive pad;

pulsing said force at a set rate in order to vary said force being exerted on said surface by said abrasive pad;

wherein during periods of maximal force, said slurry is squeezed out from between said surface and said pad in order for said pad to abrasively remove said material; and during periods of minimal force, said slurry is replenished between said wafer surface and said pad, but in order to permit said slurry to flow between said surface and said pad during periods of minimal force, said set rate must be of sufficiently low frequency so that ample time is available for slurry flow onto said surface before slurry is squeezed out from between said surface and said pad again during subsequent period of maximal force.

5. The method of claim 4 wherein said force is pulsed at a frequency of approximately 0.5–4 Hz.

6. The method of claim 5 wherein said maximal force is approximately 9–12 pounds per square inch (p.s.i.), while said minimal force is approximately 2–3 p.s.i.

7. An apparatus for polishing a surface of a semiconductor wafer by exerting a pulsed force directed substantially normal to said surface in combination with an abrasive directed across said surface to perform chemical-mechanical polishing for removing material from said surface comprising:

a wafer carrier for retaining said wafer and in which said wafer surface to be polished is exposed;

an abrasive pad disposed adjacent to said carrier and said wafer surface;

a hydrodynamic layer of chemical slurry disposed between said wafer surface and said abrasive pad;

said carrier being moved horizontally relative to said abrasive pad in order to provide a mechanical motion between said wafer surface and said abrasive pad for exertion of said abrasive motion across said wafer surface;

said carrier being forced against said pad by a force exerted substantially normal to said wafer surface in order to press said wafer surface against said abrasive pad;

said force being pulsed at a set rate in order to vary said force being exerted on said surface by said abrasive pad;

wherein during periods of maximal force, said slurry is squeezed out from between said wafer surface and said pad in order for said pad to abrasively remove said material; and during periods of minimal force, said slurry is replenished between said wafer surface and said pad, but in order to permit said slurry to flow between said surface and said pad during periods of minimal force, said set rate must be of sufficiently low frequency so that ample time is available for slurry flow onto said surface before slurry is squeezed out from between said surface and said pad again during subsequent period of maximal force.

8. The apparatus of claim 7 wherein said force has a time-averaged value approximately equal to a constant force value which would be utilized, if said polishing is achieved without pulsing said force.

9. The apparatus of claim 7 wherein said force is pulsed at a frequency of approximately 0.5–4 Hz.

10. The apparatus of claim 9 wherein said maximal force is approximately 9–12 pounds per square inch (p.s.i.), while said minimal force is approximately 2–3 p.s.i.

* * * * *